US012618638B2

(12) United States Patent
Vester, Jr.

(10) Patent No.: US 12,618,638 B2
(45) Date of Patent: May 5, 2026

(54) FIREARM SLING CONNECTOR WITH A SWIVEL ASSEMBLY

(71) Applicant: Samuel Draper Vester, Jr., Laredo, TX (US)

(72) Inventor: Samuel Draper Vester, Jr., Laredo, TX (US)

( * ) Notice: Subject to any disclaimer, the term of this patent is extended or adjusted under 35 U.S.C. 154(b) by 0 days.

(21) Appl. No.: 18/895,201

(22) Filed: Sep. 24, 2024

(65) Prior Publication Data

US 2026/0085909 A1 Mar. 26, 2026

(51) Int. Cl.
*F41C 23/02* (2006.01)

(52) U.S. Cl.
CPC ..... *F41C 23/02* (2013.01)

(58) Field of Classification Search
CPC .... F41C 33/002; F41C 33/006; F41C 33/007; F41C 33/008; F41C 23/02
USPC ..... 42/85
See application file for complete search history.

(56) References Cited

U.S. PATENT DOCUMENTS

| | | | | |
|---|---|---|---|---|
| 2,078,010 | A * | 4/1937 | Meepos | F41C 23/02 24/265 CD |
| 2,642,689 | A * | 6/1953 | Cline | F41C 23/02 24/607 |
| 2,763,082 | A * | 9/1956 | Sprague | F41C 23/02 42/85 |
| 8,516,732 | B2 * | 8/2013 | Burnsed, Jr. | F41C 23/02 403/322.2 |
| 12,140,171 | B2 * | 11/2024 | McPhee | F16B 21/165 |
| 2006/0248686 | A1 * | 11/2006 | Cook | F41C 23/02 24/2.5 |
| 2013/0333168 | A1 * | 12/2013 | Burnsed, Jr. | F41C 23/02 24/573.11 |
| 2015/0128469 | A1 * | 5/2015 | Mossie | F41C 23/02 42/90 |

* cited by examiner

*Primary Examiner* — John Cooper
(74) *Attorney, Agent, or Firm* — AVEK IP, LLC

(57) ABSTRACT

A firearm accessory connector includes a mount assembly to connect the firearm accessory connector to a firearm; a swivel assembly coupled to the mount assembly and providing for rotation around the mount assembly, the swivel assembly having a swivel sleeve coupled to the mount assembly and to rotate about the mount assembly; and a flexible member coupled to the swivel sleeve and extending from the swivel sleeve, the flexible member to attach to an accessory such that the accessory is coupled to the firearm.

12 Claims, 11 Drawing Sheets

FIREARM SLING CONNECTOR WITH A SWIVEL ASSEMBLY

BACKGROUND

1. Field

Embodiments of the disclosure relate to firearm accessory connector systems, and in particular, to a firearm sling connector having a swivel assembly specifically configured to aid in noise reduction during use.

2. Related Art

Firearm accessories and connector systems, and in particular, firearm sling connectors, are well known in the art and provide for a means to connect slings (or other accessories) to firearms. Specifically, these connectors generally include a mount assembly configured to secure the connector to the firearm, such as through conventional and known mechanisms, and a loop or similar device for attaching to a sling. Connecting a sling to a firearm is a common practice that allows for the firearm to more easily be carried on a person or stored using a sling.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

In embodiments, the disclosure relates to a firearm accessory connector comprising a mount assembly to connect the firearm accessory connector to a firearm; and a swivel assembly coupled to the mount assembly and providing for rotation around the mount assembly, the swivel assembly having a swivel sleeve coupled to the mount assembly and to rotate about the mount assembly, and a flexible member coupled to the swivel sleeve and extending from the swivel sleeve, the flexible member to attach to an accessory such that the accessory is coupled to the firearm.

BRIEF DESCRIPTION OF THE DRAWING FIGURES

Embodiments of the invention are described in detail below with reference to the attached drawing figures, wherein.

Figure 1A:
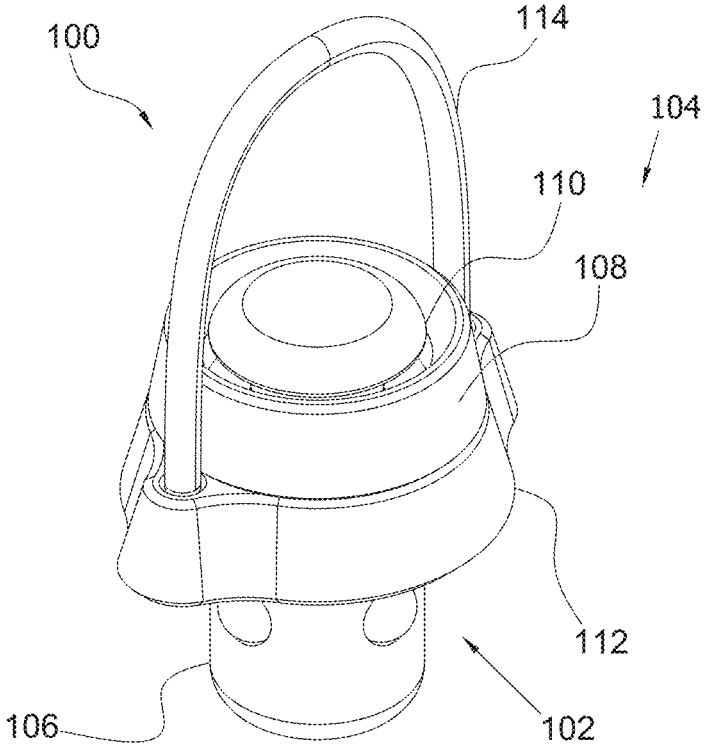
FIG. 1A is a top angled view of a first embodiment of a firearm sling connector in a locked position and in accordance with the present invention.

The drawing figures do not limit the invention to the specific embodiments disclosed and described herein. The drawings are not necessarily to scale, emphasis instead being placed upon clearly illustrating the principles of the invention

LIST OF REFERENCES

100—Firearm Sling Connector
102—Mount Assembly
104—Swivel Assembly
106—Mount
108—Upper Mount Housing
110—Button
112—Swivel Sleeve
114—Flexible Member
200—Washer/Shim
202—Stopper
400—First End of Flexible Member
402—Second End of Flexible Member
404—Stopper
406—Spring
408—Ball Bearing(s)
500—Button Top Head
502—Button Main Body
504—Button Lower Body
506—Bottom Lip
508—Indention
510—Lower Mount Housing
512—Bearing Compartment(s)
514—Inner Flexible Member
516—Outer Coating
518—Main Body
520—Channels
522—Central Opening
600—Firearm Sling Connector
601—Swivel Assembly
602—Mount Assembly
604—Flexible Member

606—Swivel Sleeve
608—M-Lock Hub
610—M-Lok Nut
612—Threaded Connector
614—Base Plate
700—Stopper
900—Stopper
902—Washer/Shim
1000—Connection Bolt
1001—Main Body
1002—Outer Coating
1004—Inner Flexible Member
1006—Main Body
1008—Channels
1010—Central Opening
1012—Threaded Receiver
1100—Firearm Sling Connector
1101—Swivel Assembly
1102—Mount Assembly
1104—Flexible Member
1106—Swivel Sleeve
1108—Wood Screw Hub
1110—Threaded Connector
1200—Stopper
1400—Stopper
1402—Washer/Shim
1500—Connection Screw
1501—Main Body
1504—Outer Coating
1506—Inner Flexible Member
1508—Main Body
1510—Channels
1512—Central Opening

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

As discussed above, firearm accessories and connector systems, and specifically firearm sling connectors, are well known in the art. Firearm sling connectors generally require some mechanism of moveability such that the sling itself can be easily moved and adjusted to various positions. Accordingly, most sling connectors have one or more hinging, rotating, or otherwise moveable mechanisms. Those skilled in the art will appreciate that moveable parts at connection points will result in unwanted noise from the associated mechanism. Noise reduction is particularly important in various uses of firearms, including both defense and sports usages of firearms. For example, in a defense situation, it may be critical that the firearm user remain as inconspicuous as possible. Similarly, in a sport situation, such as hunting, it is also important that the user remains discrete. Accordingly, it is a primary object of the present invention to provide for a firearm sling connector with a mount assembly and a swivel assembly, wherein elements of the swivel assembly aid in noise reduction during use of the connector.

Specifically, in the preferred embodiment, the swivel assembly of the present invention comprises a swivel sleeve configured to rotate around the mount assembly, the swivel sleeve connecting to a flexible member which is further configured to couple to a firearm sling. In embodiments, the flexible member is specifically coated with a material to aid in noise reduction, such as a plastic or polymer coating or a carbon wrap. Further, in embodiments, a washer is further used to dampen noise along a bottom end of the swivel sleeve, the washer being again composed of a material configured to aid in the reduction of noise, such as foam, rubber, plastics, or other appropriate materials.

Figure 1B:
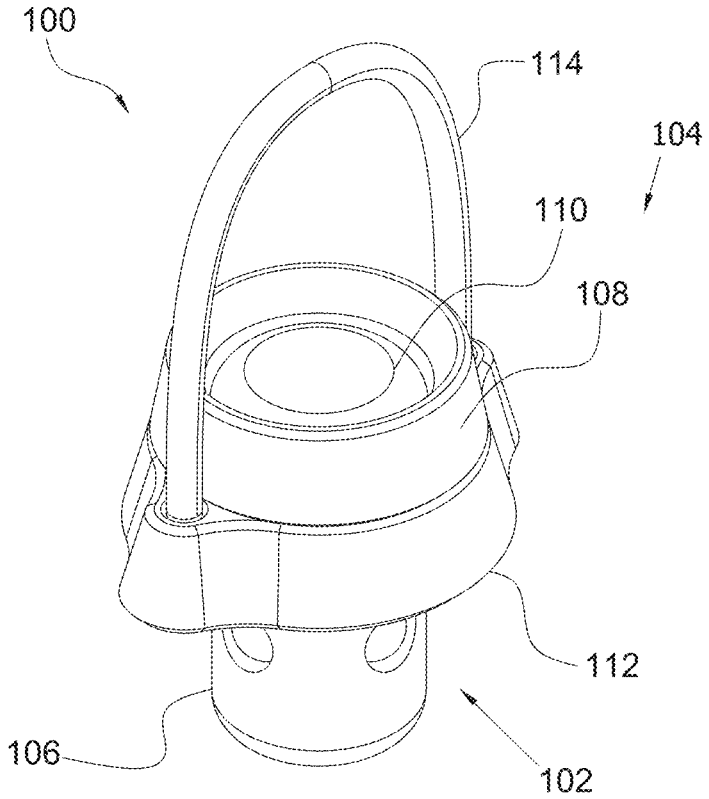
FIG. 1B is a top angled view of the first embodiment of the firearm sling connector in an unlocked position.

Turning now to FIGS. 1A and 1B, a first embodiment of a firearm sling connector 100 is shown. The sling connector 100 includes a mount assembly 102 and a swivel assembly 104 as the primary components. The purpose of the mount assembly 102 is to connect the sling connector 100 to a firearm (not shown). Specifically, the mount assembly 102 can come in any number of configurations to mount to universal and known firearm mount systems and the present invention should not be construed as limited to any specific style of mount. Yet further, the mount assembly 102 may be custom made or incorporate future developments. For example, the three embodiments shown in the present application show configurations for a standard QD mount, M-Lok mount, and wood screw mount.

The mount assembly 102 of the first embodiment includes a mount 106 to couple the sling connector 100 to the firearm. In the embodiment shown in FIGS. 1A and 1B, the mount 106 is a known QD mount. The mount assembly 102 further includes an upper mount housing 108 and a button 110. As will be discussed in more detail herein, the button 110 is configured to operate the mount assembly 102 between a locked and unlocked configuration to lock into a mount receiver on a firearm (not shown).

The swivel assembly 104 is considered unique to the present invention and includes a plurality of features for aiding in noise reduction during the use of the connector 100 and provides for a rotation/swivel function around the mount assembly 102. In embodiments, the swivel assembly 104 can rotate 360 degrees. The swivel assembly 104 includes a swivel sleeve 112 coupled to the mount assembly 102, the swivel sleeve 112 being configured to rotate around the mount assembly 102. A flexible member 114 extends and curves over the top of the swivel sleeve 112 and provides a connection point to connect an accessory. For example, a clip/clasp/hook or similar connection mechanism, as would be understood by those skilled in the art, can connect to the flexible member 114 to connect the sling thereto.

Figure 2B:
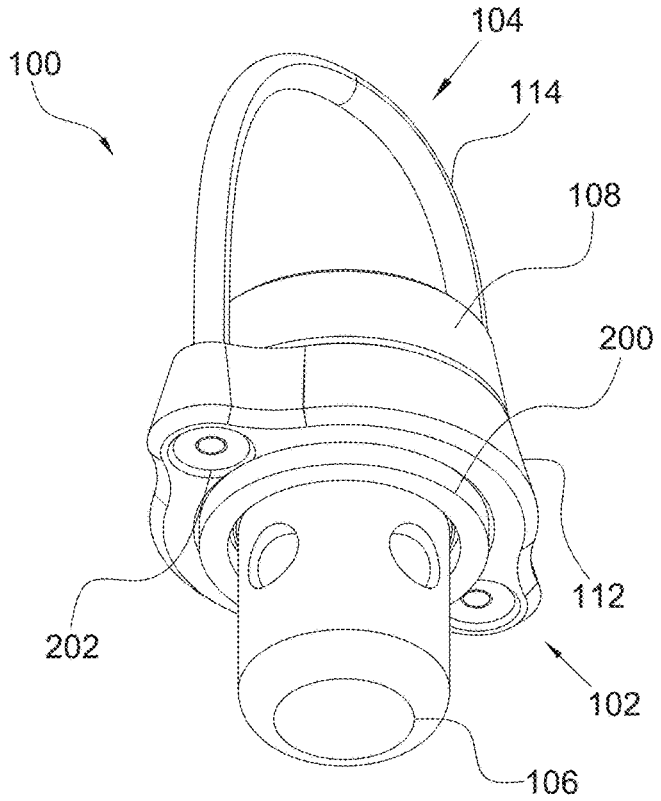
FIG. 2B is a bottom angled view of the first embodiment of the firearm sling connector in the unlocked position.
Figure 2A:
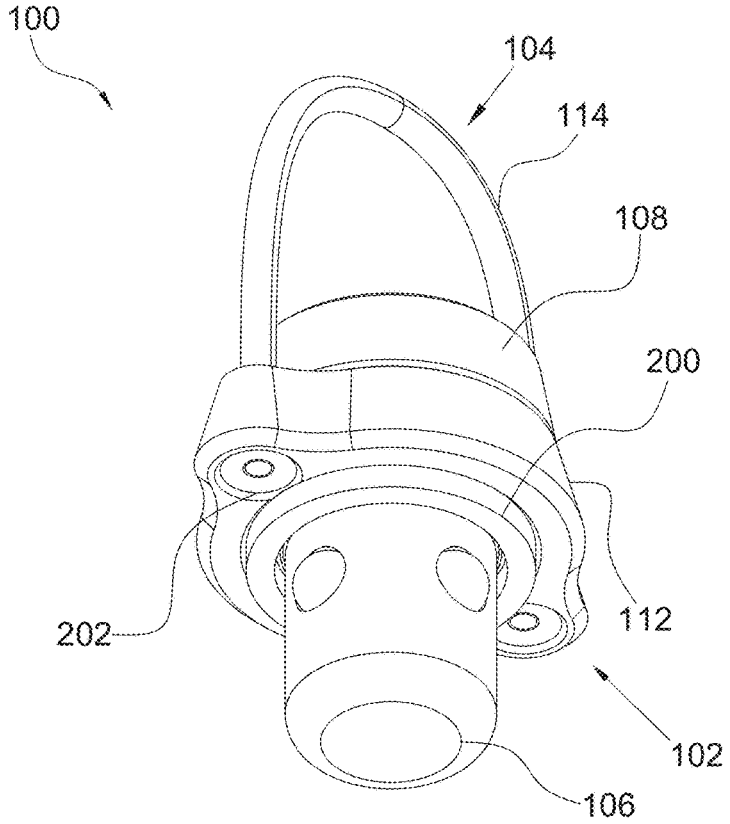
FIG. 2A is a bottom angled view of the first embodiment of the firearm sling connector in the locked position.

Turning now to FIGS. 2A and 2B, the sling connector 100 is shown from a bottom angled view. Here, a first stopper 202 is shown embedded within the swivel sleeve 112 and coupled to the flexible member 114. The stopper 202 aids in retaining the flexible member 114 to the swivel sleeve 112 and is composed of a material that aids in retaining the flexible member 114 with a high pull strength. For example, the stopper 202 may be composed of aluminum or copper or other suitable materials.

Figure 3A:
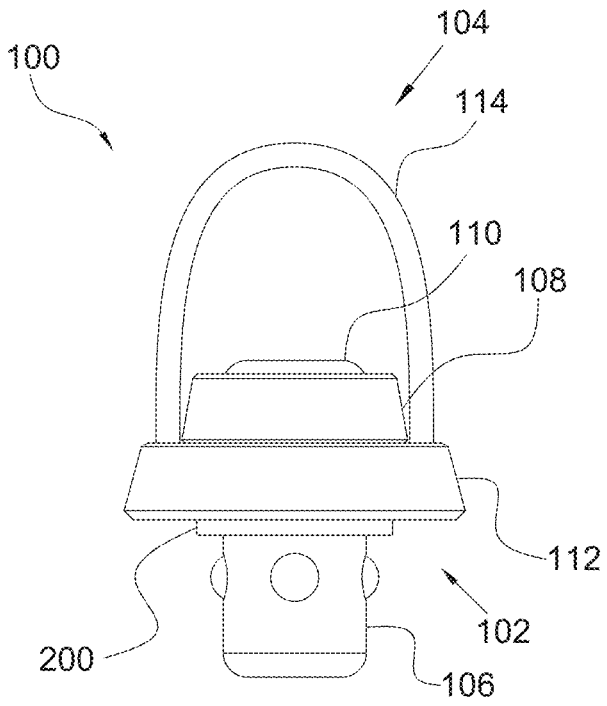
FIG. 3A is a side view of the first embodiment of the firearm sling connector in the locked position.
Figure 3B:
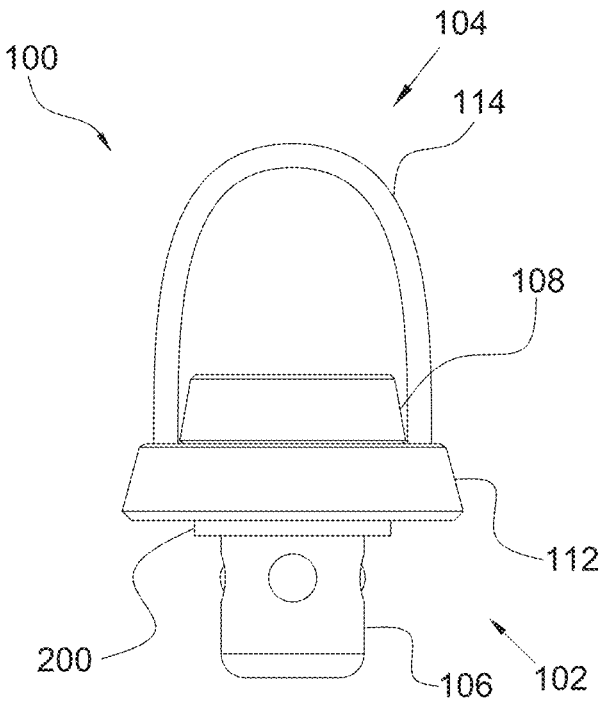
FIG. 3B is a side view of the first embodiment of the firearm sling connector in the unlocked position.

FIGS. 3A and 3B are shown for clarity. As shown in FIGS. 3A, when the button 110 is extended, a plurality of ball bearings 408 protrude out of the mount 106 which locks the mount 106 within a mount receiver (not shown). Those skilled in the art will understand this as a conventional QD mount configuration. In FIG. 3B, the button 110 is shown depressed, wherein the ball bearings 408 are retraced inward (as will be shown in better detail later herein), which creates the unlocked configuration, again as would be understood by those skilled in the art. These figures further show a washer 200 coupled to the bottom of the swivel sleeve 112. The washer 200 may vary in size as would be appropriate for various mounting mechanisms and may be affixed to the swivel sleeve 112 or alternatively may remain unattached to the swivel sleeve 112. The washer 200 will be composed of a material again appropriate to aid in noise reduction, such as foam, or another shock absorbing material.

Figure 4B:
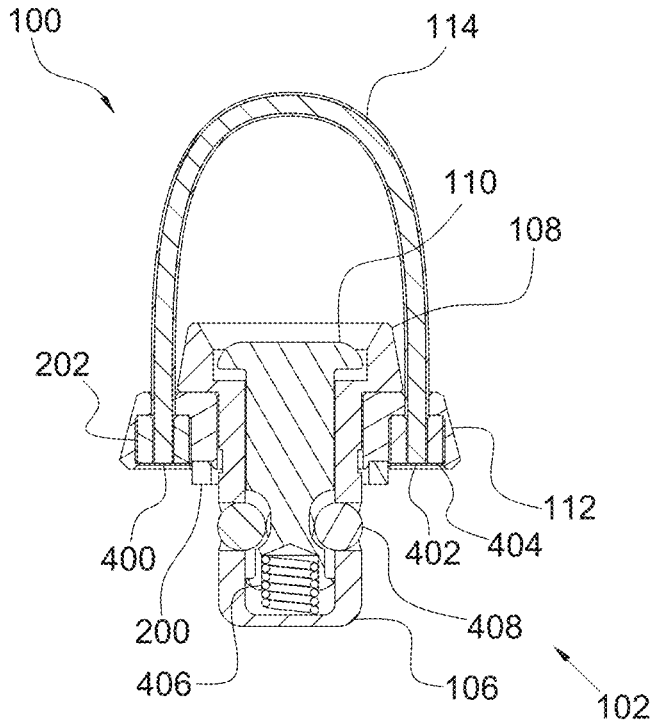
FIG. 4B is a side, cross-sectional view of the first embodiment of the firearm sling connector in the unlocked position.
Figure 4A:
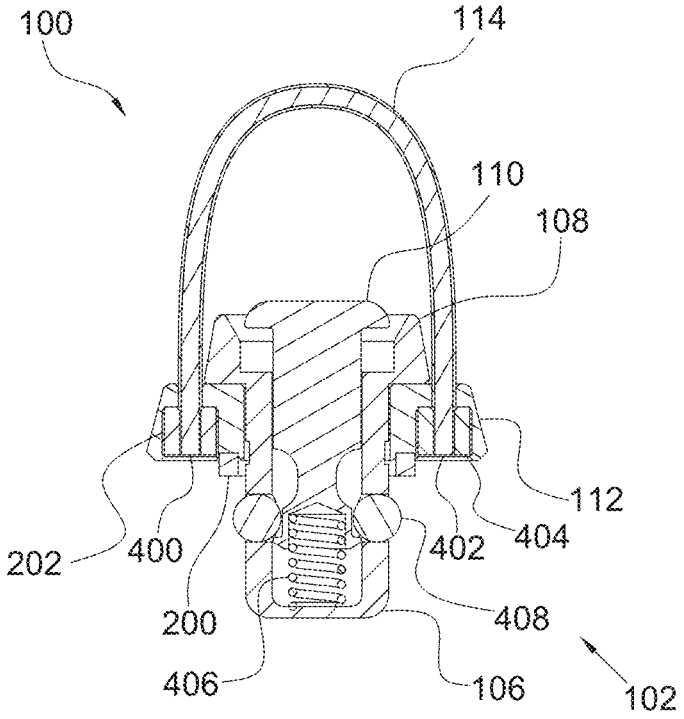
FIG. 4A is a side, cross-sectional view of the first embodiment of the firearm sling connector in the locked position.

FIGS. 4A and 4B show the sling connector 100 in cross sectional views which better demonstrate the internal workings of the mount assembly 102. As shown, when the button 110 is extended outward (FIG. 4A), the ball bearings 408 are forced into the outward position, which will lock the mount 106 into a mount receiver (not shown). To unlock, a user will depress the button 110 against a spring 406, creating space for the ball bearings 408 to move inward (as shown in FIG. 4B). In this unlocked position, the mount 106 can be inserted into the mount receiver, the button 110 then released, and the ball bearings 408 forced back into the locked position (FIG. 4A). These figures further demonstrate that the flexible member 114 extends from a first end 400 to a second end 402, the ends 400, 402 extending into the swivel sleeve 112 and being secured in place via stoppers 202, 404.

Figure 5:
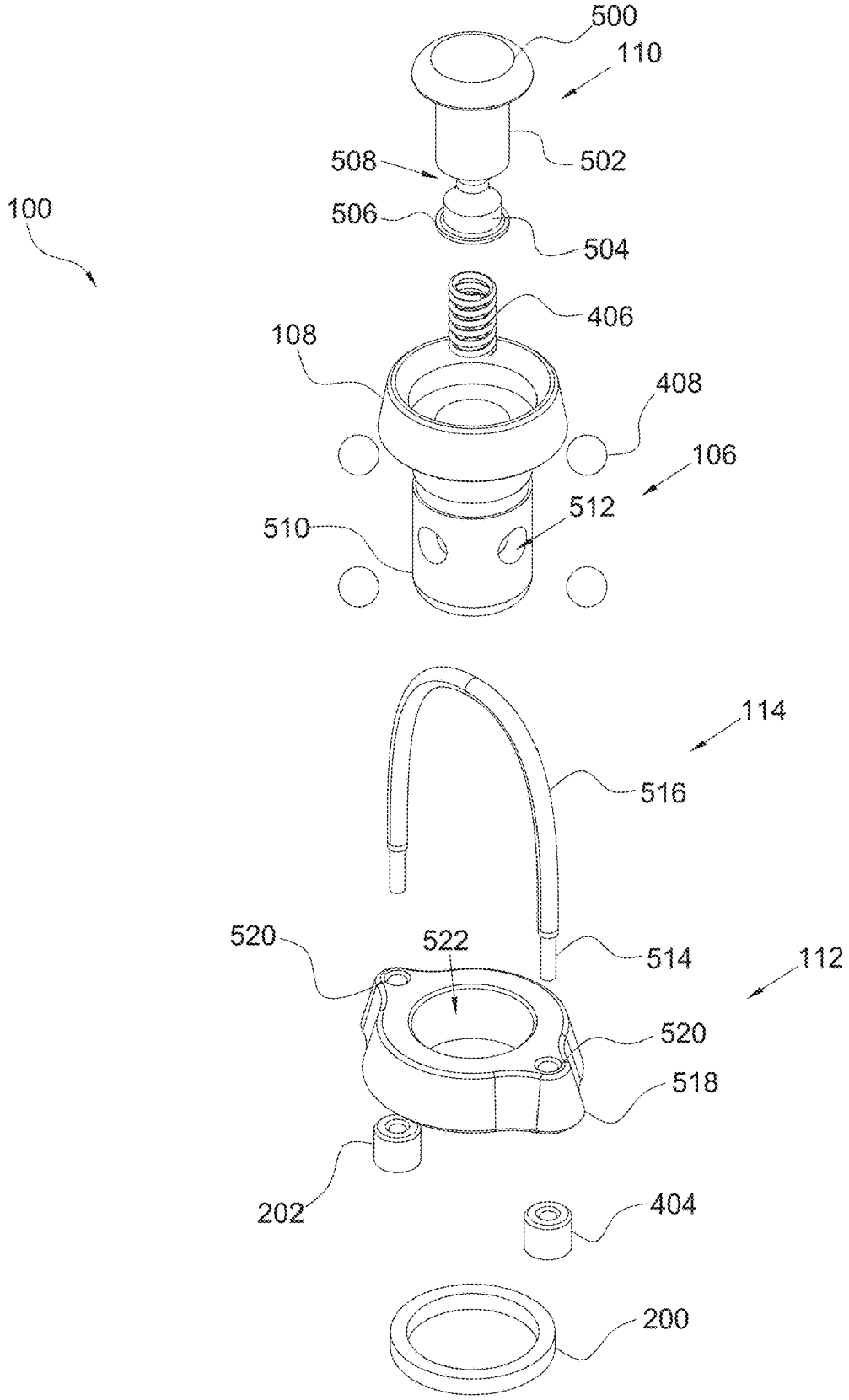
FIG. 5 is an exploded view of the first embodiment of the firearm sling connector.

In FIG. 5, an exploded view demonstrates the sling connector 100 individual components. As shown, the button 110 includes a button top head 500 connected to a button main body 502, which is further connected to a button lower body 504. A bottom lip 506 extends from a rim of the lowermost end and is configured to support the ball bearings 408 in the locked configuration (as shown in FIG. 4A). An indention 508 extends inward in a space between the main body 502 and the lower body 504 and provides space for the ball bearings 408 to be drawn inward when the button is depressed (as shown in FIG. 4B).

Turning now to the mount 106. The mount 106 includes the upper mount housing 108 connected to a lower mount housing 510 having a plurality of bearing compartments 512 to allow the ball bearings 408 to extend and contract therethrough. The button 110 extends into the mount 106 and is further supported by the spring 406 to provide for depression of the button 110 as would be understood by those skilled in the art.

Turning now to the flexible member 114. The flexible member 114, in embodiments, includes an inner flexible member 514 with an outer coating 516. The outer coating 516 is specifically selected to provide noise damping, such as being a plastic, rubber, polymer, or other soft coating that will absorb impact and reduce noise. For example, if a user connects a metal clasp to the flexible member 114, the outer coating 516 aids in absorbing movement and noise associated with the metal clasp. The inner flexible member 514 can be any material that would allow for flexibility, such as a metal or steel cable.

Turning now to the swivel sleeve 112. The swivel sleeve 112 includes a main body 518 with two side channels 520 for receiving the ends of the flexible member 114. A central opening 522 encircles the mount assembly 102, specifically the lower mount housing 510 in the first embodiment, wherein the central opening 522 allows for the swivel sleeve 112 to spin/rotate around the lower mount housing 510.

In FIGS. 6-10, a second embodiment of a firearm sling connector 600 is shown. Those skilled in the art will appreciate that the features of the embodiments may be interchanged, without departing from the novelty of the present invention. Specifically, all embodiments include the swivel assembly that is unique to the present invention, while each embodiment provides for different mounting assemblies such that the present invention may be utilized with different firearms and different mounting systems.

Figure 6:
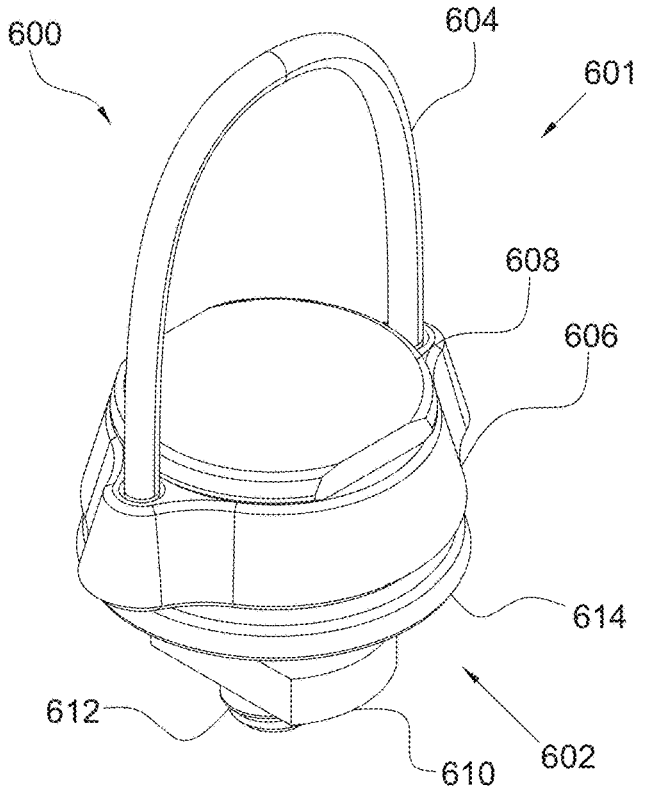
FIG. 6 is a top angled view of a second embodiment of a firearm sling connector in accordance with the present invention.
Figure 7:
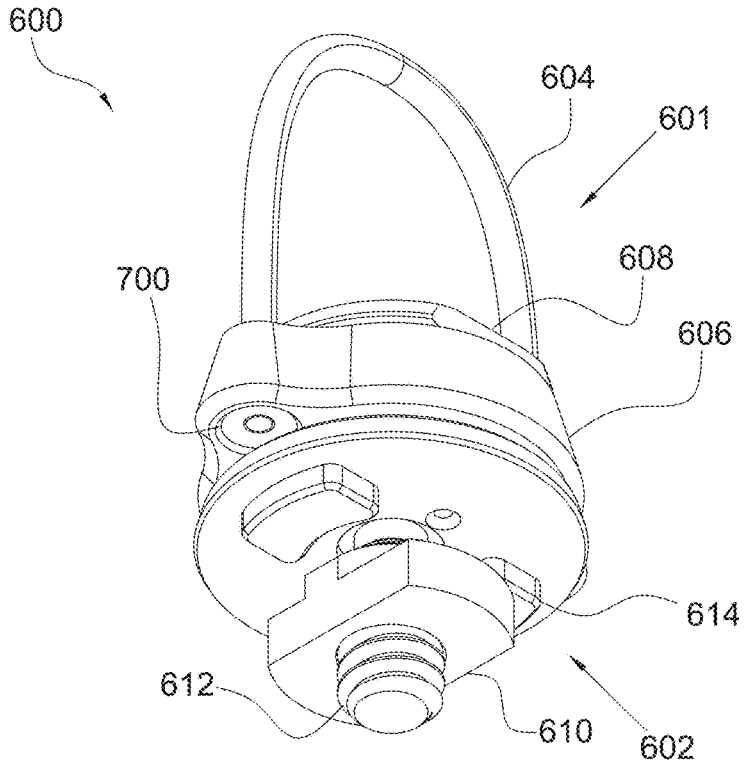
FIG. 7 is a bottom angled view of the second embodiment of the firearm sling connector.
Figure 8:
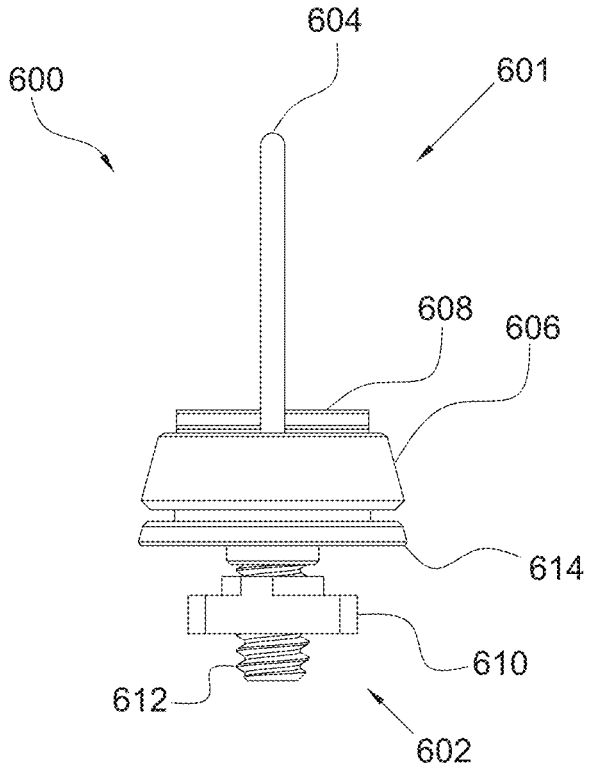
FIG. 8 is a side view of the second embodiment of the firearm sling connector.

In FIGS. 6 and 7, the firearm sling connector 600 is shown from two different perspective views. In FIG. 8, the firearm sling connector 600 is shown from a side view. The connector 600 includes a swivel assembly 601 which is substantially similar to the prior discussed swivel assembly 104. Here, a mount assembly 602 is specifically an M-Lok mount assembly, such that the mount assembly 602 connects to a firearm having an M-Lok mounting system.

As also discussed above, the swivel assembly 601 includes a flexible member 604 extending over a top portion of assembly and connecting to a swivel sleeve 606. The swivel sleeve 606 is configured to provide 360 degrees of rotation around the mount assembly 602. Those skilled in the art will again appreciate that minor modifications, such as to the size of the flexible member 604 and swivel sleeve 606, may be appropriate.

The mount assembly 602 includes an M-Lok hub 608, an M-Lok nut 610, a threaded connector 612, and a base plate 614. Although these features may be changed, those skilled in the art will appreciate that these elements provide a conventional M-Lok connection system.

Figure 9:
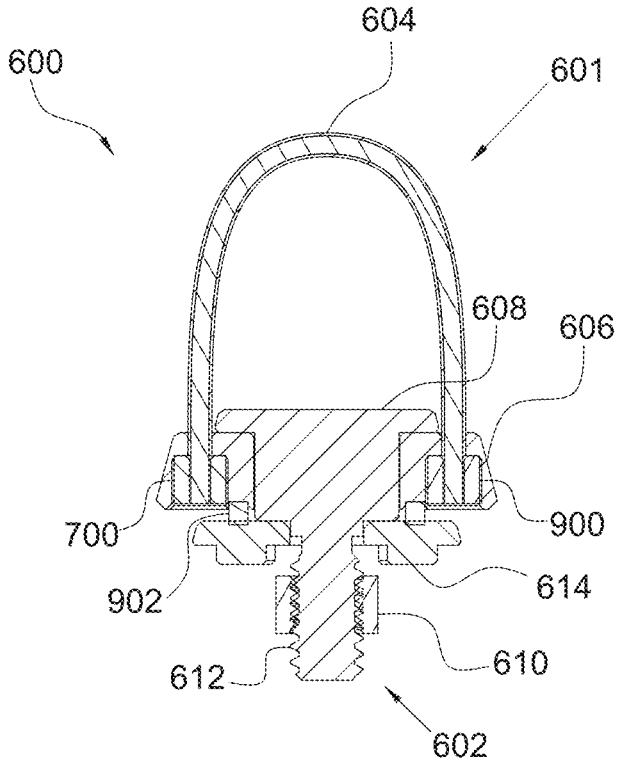
FIG. 9 is a side, cross-sectional view of the second embodiment of the firearm sling connector.

As shown in FIG. 7 and FIG. 9, and as discussed in more detail herein and previously discussed above, the flexible member 604 inserts into the swivel sleeve 606 and into stoppers 700, 900. Also shown in FIG. 9, a washer 902 is positioned around the mount assembly 602, at a position below the swivel sleeve 606 and above the base plate 614. The washer 902 is composed of a flexible material, such as foam, plastic, rubber, or other similar, shock absorbing materials. The washer 902 may vary in dimensions as needed for functional, aesthetic, or manufacturing purposes.

Figure 10:
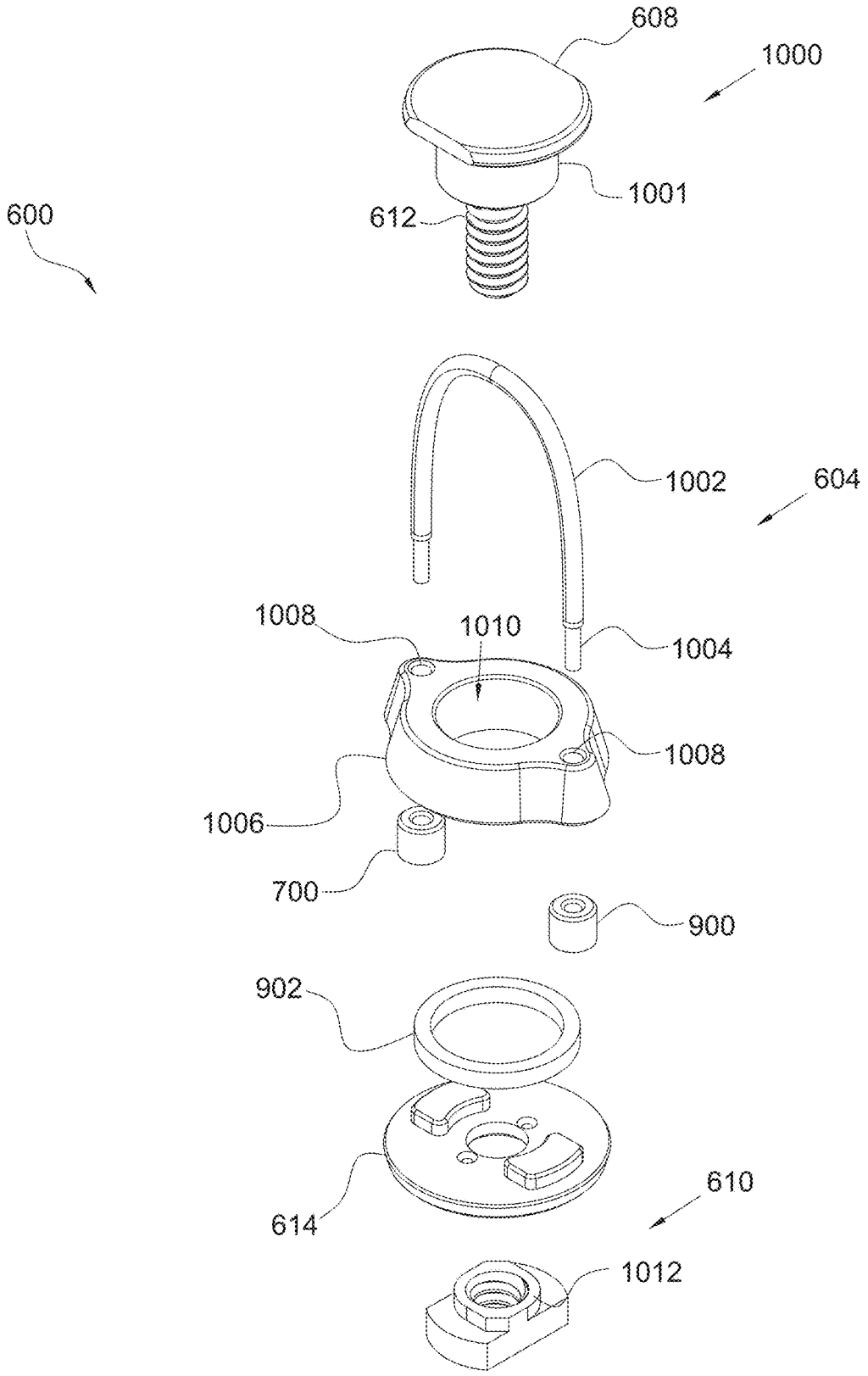
FIG. 10 is an exploded view of the second embodiment of the firearm sling connector.
Figure 11:
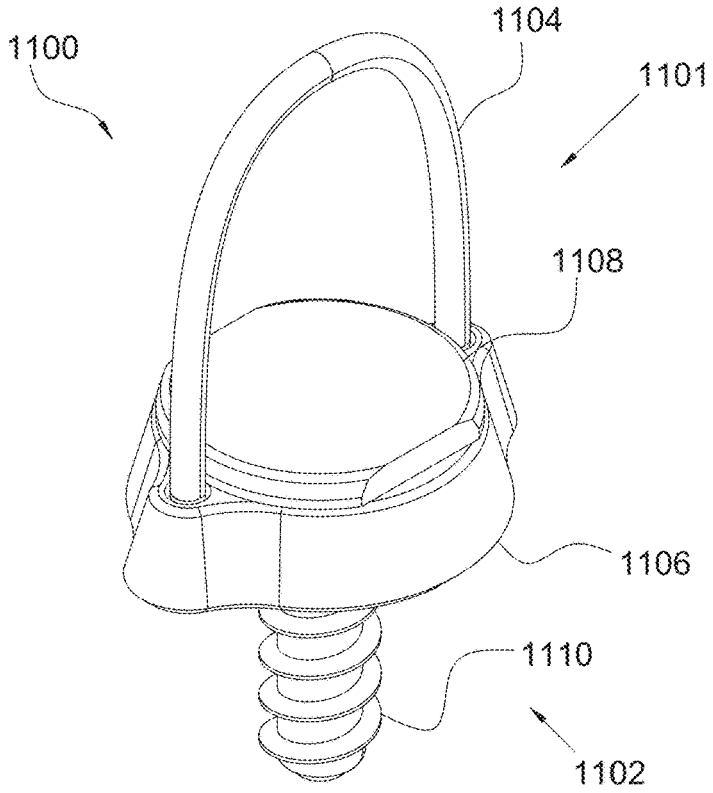
FIG. 11 is a top angled view of a third embodiment of a firearm sling connector in accordance with the present invention.
Figure 12:
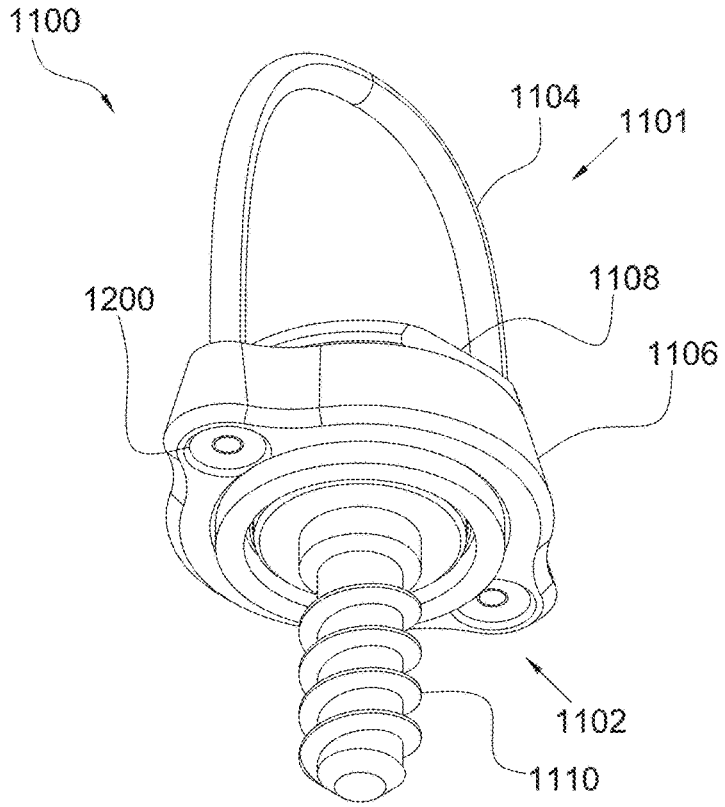
FIG. 12 is a bottom angled view of the third embodiment of the firearm sling connector.
Figure 13:
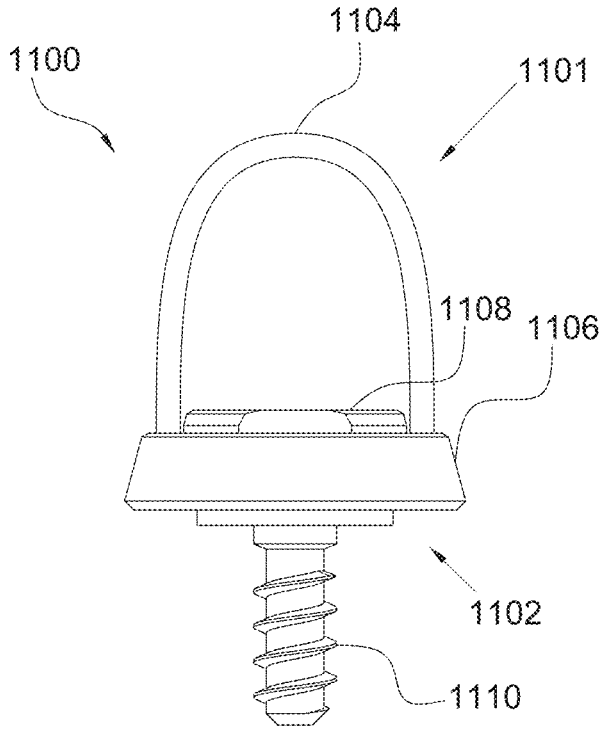
FIG. 13 is a side view of the third embodiment of the firearm sling connector.

In FIG. 10, the connector 600 is shown in a disassembled and exploded view. A connection bolt 1000 as part of the mount assembly 602 forms the M-Lok hub 608 connected to a main body 1001, further connected to the threaded connector 612. The main body 1001, as shown, includes a smooth outer surface wherein the swivel sleeve 606 will engage and be configured to rotate therearound.

Turning now to the flexible member 604. The flexible member 604, in embodiments includes an inner flexible member 1004 with an outer coating 1002. The outer coating 1002 is specifically selected to provide noise damping properties and is therefore composed of a suitable material such as a plastic or other soft coating that will absorb impact and reduce noise. The inner flexible member 1004 can be any material that would allow for flexibility, such as a metal or steel cable.

Turning now to the swivel sleeve 606. The swivel sleeve 606 includes a main body 1006 with two side channels 1008 for receiving the ends of the flexible member 604. A central opening 1010 encircles the main body 1001 of the connection bolt 1000, wherein the central opening 1010 allows for the swivel sleeve 606 to spin/rotate around the main body 1001.

FIG. 9 further demonstrates the stoppers 700, 900 which insert into the swivel sleeve 606 to receive the ends of the flexible member 604 to retain the flexible member therein. Further shown in FIG. 9 is the M-Lok nut 610 having a threaded receiver 1012 to threadingly engage with the threaded connector 612 as is part of a conventional M-Lok connection system.

FIGS. 11-15 depict a third embodiment of a firearm sling connector 1100 in accordance with the present invention. Again, those skilled in the art will appreciate that the features can be interchanged between embodiments of the present invention without departing from the novelty discussed herein. The connector 1100 includes a swivel assembly 1101 and a mount assembly 1102. Here, the mount assembly 1102 is a wood screw, as would be applicable for use with various firearms. The swivel assembly 1101 again includes a flexible member 1104 and a swivel sleeve 1106. The mount assembly 1102 includes a wood screw hub 1108 and a threaded connector 1110. As previously discussed, the swivel sleeve 1106 provides for 360 degrees of rotation around the mount assembly 1102. Also as discussed above, the flexible member 1104 engages and inserts into stoppers 1200, 1400.

Figure 14:
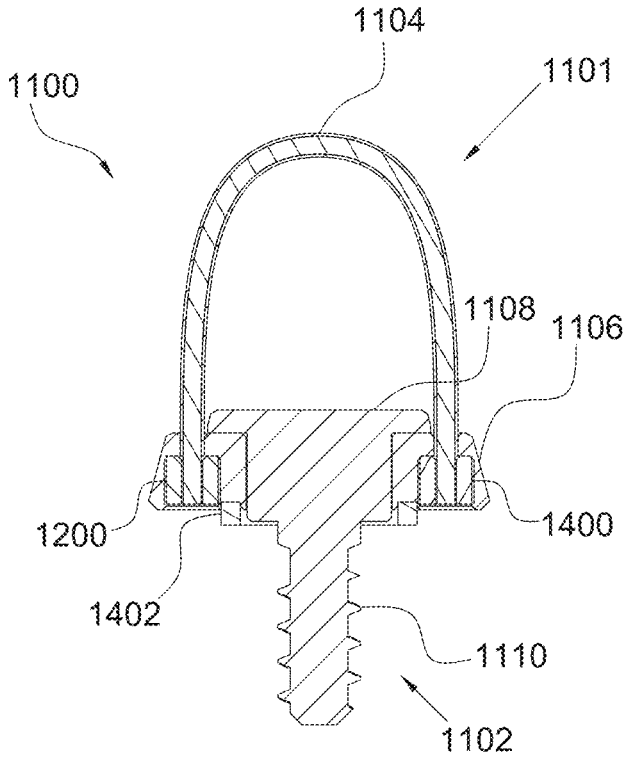
FIG. 14 is a side, cross-sectional view of the third embodiment of the firearm sling connector.

Turning to FIG. 14, a cross-sectional view further depicts the engagement between the swivel assembly 1101 and the mount assembly 1102. In addition, a washer 1402 is shown positioned just below the bottom of the swivel sleeve 1106 again for aiding in noise reduction.

Figure 15:
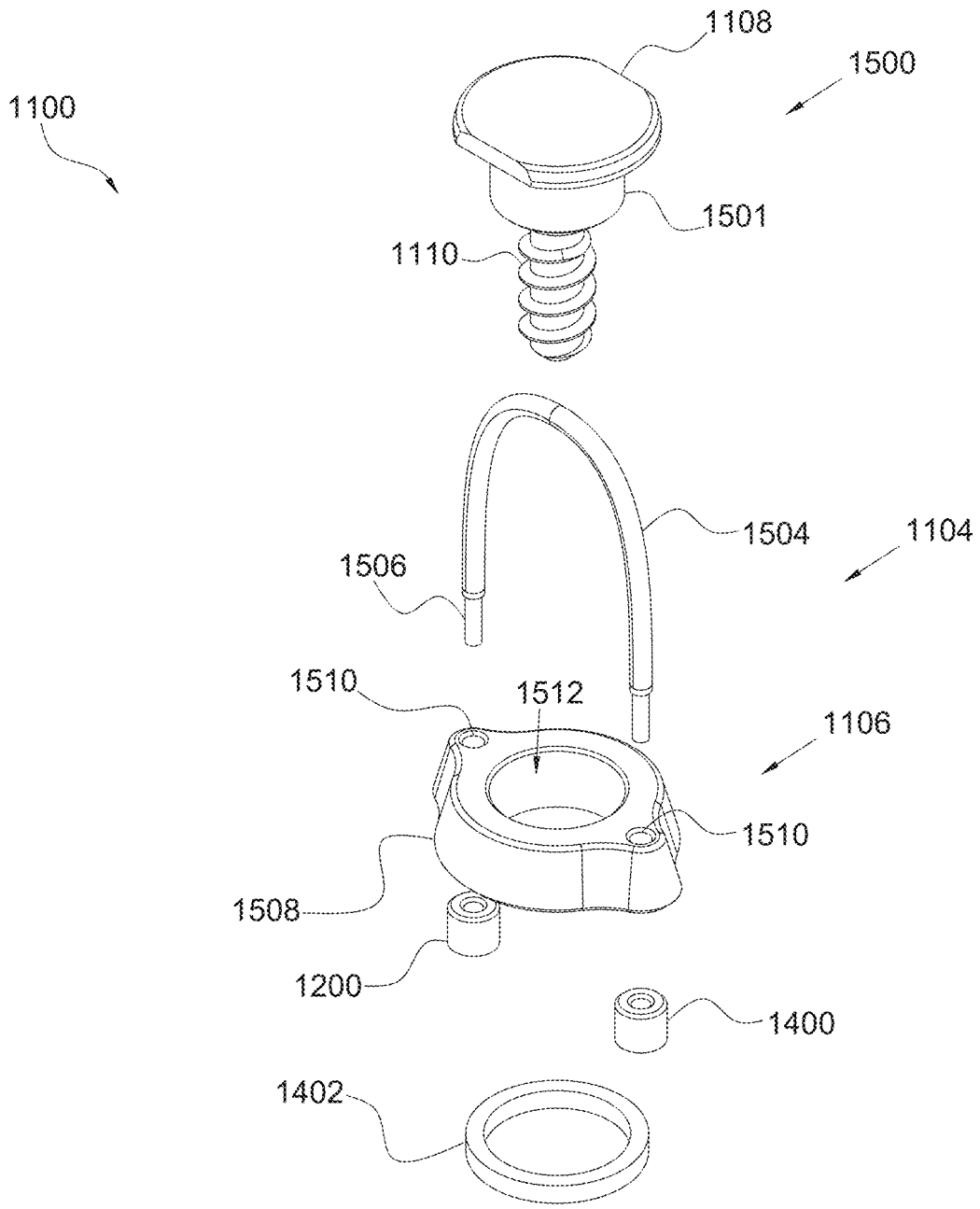
FIG. 15 is an exploded view of the third embodiment of the firearm sling connector.

Turning now to FIG. 15, the exploded view further depicts the features of the firearm sling connector 1100. The mount assembly including a connection screw 1500 having the wood screw hub 1108 connected to a main body 1501 further connected to the threaded connector 1110.

Turning now to the flexible member 1104. The flexible member 1104, in embodiments includes an inner flexible member 1506 with an outer coating 1504. The outer coating 1504 is specifically selected to provide noise damping and the inner flexible member 1506 being composed of a material to allow for flexibility.

Turning now to the swivel sleeve 1106. The swivel sleeve 1106 includes a main body 1508 with two side channels 1510 for receiving the ends of the flexible member 1104. A central opening 1512 encircles the main body 1501 of the connection screw 1500, wherein the central opening 1512 allows for the swivel sleeve 1106 to spin/rotate around the main body 1501.

During use, a user will select an appropriate embodiment of the firearm sling connector. This selection may not be limited to the embodiments shown, but rather will be made based on their specific firearm and connection assembly (QD, M-Lok, Wood Screw, Etc.). Using the associated mounting assembly, the user will mount the selected firearm sling connector to their firearm. The flexible member of the selected embodiment will then be used to connect to an accessory (firearm sling), such that the sling can be utilized by the user to transport the firearm, or for any other appropriate purpose. The features of the swivel assembly, for any of the embodiments discussed, provide for an improved device that reduces noise associated with conventional sling connectors.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. A firearm accessory connector, comprising:

a mount assembly configured to connect the firearm accessory connector to a firearm;

a swivel assembly coupled to the mount assembly and providing for rotation around the mount assembly, the swivel assembly having:

a swivel sleeve coupled to the mount assembly and configured to rotate about the mount assembly; and a flexible member coupled to the swivel sleeve and extending from the swivel sleeve, the flexible member configured to attach to an accessory such that the accessory is coupled to the firearm, the flexible member including an inner flexible member extending from a first end to a second end, the first end and the second end coupled to the swivel sleeve; and an outer coating covering at least a portion of the inner flexible member, the outer coating configured to dampen noise associated with movement of the flexible member;

the swivel sleeve including a main body with a first channel configured to receive the first end of the inner flexible member and a second channel configured to receive the second end of the inner flexible member; and a central opening through which the mount assembly extends.

2. The firearm accessory connector of claim 1, wherein the swivel assembly is configured to provide 360 degrees of rotation around the mount assembly.

3. The firearm accessory connector of claim 1, wherein the inner flexible member is a steel cable.

4. The firearm accessory of claim 1, wherein the swivel assembly further comprises a first stopper positioned within the first channel and surrounding the first end of the inner flexible member, and a second stopper positioned within the second channel and surrounding the second end of the inner flexible member, wherein the first stopper and the second stopper are configured to retain the flexible member therein.

5. The firearm accessory of claim 4, wherein the first stopper and the second stopper are composed of one of aluminum or copper.

6. The firearm accessory connector of claim 1, wherein the swivel assembly further comprises a washer surrounding at least a portion of the mount assembly, the washer positioned at least partially below the swivel sleeve.

7. The firearm accessory connector of claim 1, wherein the mount assembly further comprises:

a mount configured to couple to the firearm, the mount having an upper mount housing and a lower mount housing;

a button extending into the mount and operable between an unlocked position and a locked position.

8. The firearm accessory connector of claim 7, wherein the mount assembly further comprises:

a plurality of ball bearings housed within the mount;

a spring housed within the mount;

wherein the spring is compressed when the button is manipulated into the unlocked position and the plurality of ball bearings are moveable from a first position to a second position when the button is manipulated between the unlocked position and the locked position.

9. The firearm accessory connector of claim 1, wherein the mount assembly further comprises:

a main body extending through the swivel sleeve such that the swivel sleeve is configured to rotate around the main body;

a hub coupled to a top end of the main body and extending from a top end of the swivel sleeve; and a connector coupled to a bottom end of the main body and configured to secure the firearm accessory to the firearm.

10. The firearm accessory connector of claim 9, wherein the mount assembly further comprises an M-Lok nut threaded onto the connector.

11. The firearm accessory connector of claim 9, wherein the mount assembly further comprises a base plate coupled to the main body at a position below the swivel sleeve.

12. The firearm accessory connector of claim 9, wherein the connector is wood screw connector.

* * * * *